United States Patent [19]

Miyauchi et al.

[11] Patent Number: 4,772,378

[45] Date of Patent: Sep. 20, 1988

[54] PROCESS FOR THERMAL CRACKING OF HEAVY OIL

[75] Inventors: Terukatsu Miyauchi, Yokohama; Yoneichi Ikeda, Kamakura; Tatsuji Kikuchi, Tokyo, all of Japan

[73] Assignee: Fuji Standard Research Kabushiki Kaisha, Otemachi, Japan

[21] Appl. No.: 63,766

[22] Filed: Jun. 23, 1987

Related U.S. Application Data

[63] Continuation of Ser. No. 834,424, Feb. 28, 1986, abandoned.

[30] Foreign Application Priority Data

Feb. 28, 1985 [JP] Japan ..... 60-40103

[51] Int. Cl.[4] ..... C10G 9/32

[52] U.S. Cl. ..... 208/107; 208/127; 208/130

[58] Field of Search ..... 208/127, 107, 130, 128

[56] References Cited

U.S. PATENT DOCUMENTS

| | | | |
|---|---|---|---|
| 2,895,896 | 7/1959 | Vander Ploeg | 208/127 |
| 2,917,451 | 12/1959 | Leffer | 208/107 |
| 3,726,791 | 4/1973 | Kimberlin, Jr. et al. | 208/127 |
| 3,941,681 | 3/1976 | Saegusa et al. | 208/107 |
| 4,220,518 | 9/1980 | Uchida et al. | 208/127 |
| 4,263,128 | 4/1981 | Bartholic | 208/93 |
| 4,298,457 | 11/1981 | Oblad et al. | 208/107 |
| 4,331,529 | 5/1982 | Lambert et al. | 208/127 |
| 4,446,009 | 5/1984 | Bartholic | 208/127 |
| 4,490,243 | 12/1984 | Miyauchi et al. | 208/127 |

*Primary Examiner*—Anthony McFarlane

*Attorney, Agent, or Firm*—Oblon, Fisher, Spivak, McClelland & Maier

[57] ABSTRACT

Disclosed is a process for the thermal cracking of heavy oils, which comprises a thermal cracking step of contacting a heavy oil with a fine powder of a porous material fluidized by a fluidizing gas to mainly obtain a light oil and a regenerating step of gasifying and removing coke adhering to the fine powder taken out from the thermal cracking step while fluidizing the fine powder by a molecular oxygen-containing gas and a steam-containing gas, the fine powder being circulated between the two steps, wherein fine spherical particles having a pore volume of 0.2 to 1.5 $cm^3/g$, a specific surface area of 5 to 1500 $m^2/g$, an average pore size of 10 to 10,000 Å and a weight average size of 0.025 to 0.25 mm, in which these properties are stably maintained at the temperature adopted for the thermal cracking, are used as the fine powder, and a hydrogen gas is made present at the thermal cracking step, the partial pressure of hydrogen is maintained at about 0.5 to about 5 $Kg/cm^2$ and the total pressure at said step is maintained at about 1 to about 10 $Kg/cm^2$-G.

11 Claims, 1 Drawing Sheet

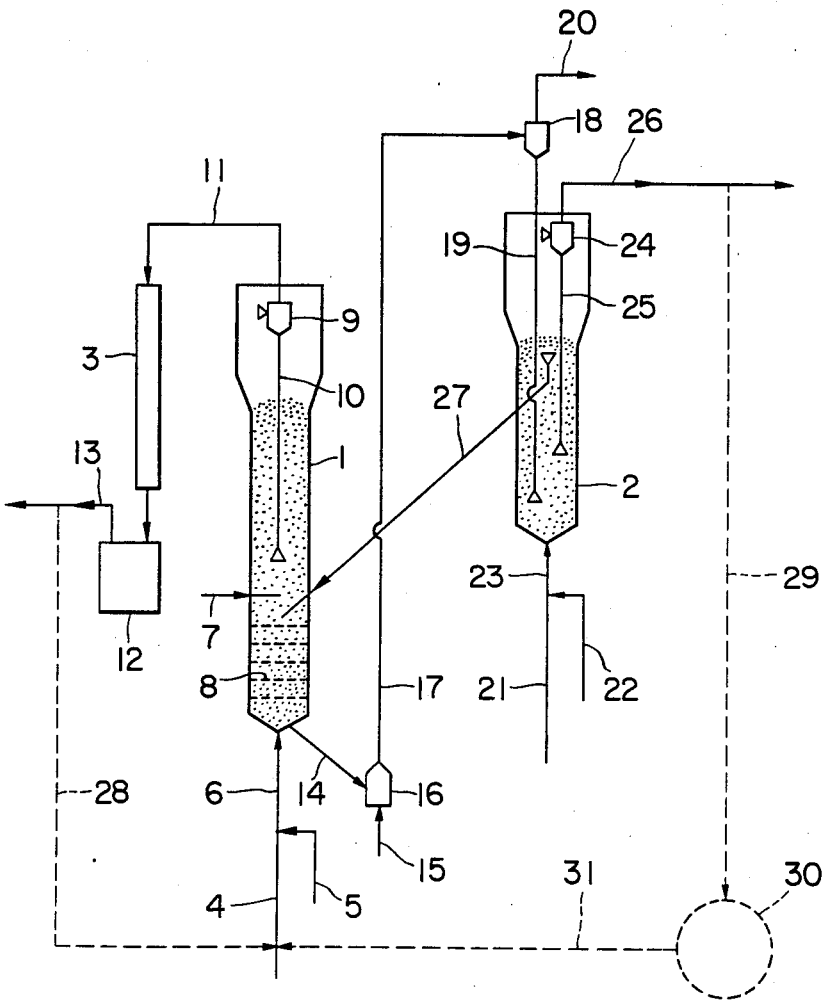
20
18
26
11
19
24
25
9
3
10
27
13
1
2
23
29
7
12
8
17
21
22
28
6
14
16
15
31
30
4
5

PROCESS FOR THERMAL CRACKING OF HEAVY OIL

This application is a continuation of application Ser. No. 834,424, filed on Feb. 28, 1986, now abandoned.

BACKGROUND OF THE INVENTION

1. Field of the Invention

The present invention relates to a process in which a heavy hydrocarbon oil (hereinafter referred to as "heavy oil") is thermally cracked by using a fluidized bed of "heat carrier" particles to obtain mainly a light hydrocarbon oil which is liquid at normal temperature (hereinafter referred to as "light oil"). More particularly, the present invention relates to an improvement of the thermal cracking process comprising (1) a thermal cracking step of contacting a heavy oil with a fine powder of a porous material fluidized by a steam-containing gas to effect the thermal cracking of the heavy oil and (2) a regenerating step of fluidizing the fine powder removed from the thermal cracking step with a molecular oxygen-containing gas or a steam-containing gas and burning or gasifying coke adhering to the powder to effect removal of coke, the powder being circulated between the two steps.

2. Description of the Prior Art

Some of the present inventors clarified that, in the thermal cracking of a heavy oil by using a fluidized bed of heat carrier particles, if particles having a substantially spherical shape and a weight average particle size of 0.04 to 0.12 mm and containing particles having a size of or smaller than 0.044 mm in an amount of 5 to 20% by weight are used as particles to be fluidized, the efficiency of the thermal cracking can be increased while maintaining of a good fluidized state (see Japanese Patent Application Laid-Open Specification No. 10587/81). The present inventors have designated this process as "fluid thermal cracking process" or simply as "FTC PROCESS".

Furthermore, we found that in the above-mentioned thermal cracking process, if particles having a pore volume of 0.1 to 1.5 $m^3/g$, a specific surface area of 50 to 1500 $m^2/g$ and a weight average particle size of 0.025 to 0.25 mm, which are thermally stabilized, are used as the fine powder, the thermal cracking efficiency can be further increased and that by absorption of the heavy oil in the liquid state in fine pores of the porous material, there can be attained an excellent effect of promoting the thermal cracking reaction and controlling formation of a high-carbon adhering substance (hereinafter referred to as "coke") (Japanese Patent Application Laid-Open Specification No. 18783/82). The present inventors have designated this effect as "capacitance effect".

Furthermore, in connection with the thermal cracking process comprising the step of thermally cracking a heavy oil which is combined with a gasifying step of contacting the fine powder of a porous material taken out from the thermal cracking step with an oxygen-containing gas to gasify and remove the coke adhering to the fine powder (this step is called "regenerating step" in the present invention), the fine powder being circulated between the two steps, the present inventors have proposed an effective embodiment in which a vertical reactor having at least three defined compartments in it is used at the thermal cracking step (Japanese Patent Application Laid-Open Specification No. 180590/83) and another effective embodiment in which the regeneration step is divided into a gasifying zone and a burning zone and gases generated in the two zones are separately taken out (Japanese Patent Application Laid-Open Specification No. 115387/84).

The feed heavy oil contains relatively large amounts of heavy metals such as nickel, vanadium and iron in addition to CCR (Conradson carbon residue) and a sulfur compound. In the conventional catalytic cracking using catalyst particles, and in the case where the feed oil contains large amounts of heavy metals, these heavy metals are accumulated on the catalyst and have adverse influences on the cracking reaction, as is well-known in the art. More specifically, since nickel or vanadium has a dehydrogenating catalytic activity, it excessively advances the cracking reaction of the starting oil to increase the amount of hydrogen and the amount of coke, resulting in reduction of the oil yield and quality of the cracked oil.

Adverse influences of these contaminating heavy metals cannot be avoided even in the thermal cracking using a fine powder of a porous material having no substantial catalytic activity although the degree may be lower.

As means for overcoming this disadvantage, there has been proposed a method in which a catalyst for use in the catalytic cracking of a feed oil containing heavy metals is covered with an antimony component or other transition metal component to render the heavy metals on the catalyst passivated (see, for example, Japanese Patent Application Laid-Open Specification NO. 104588/78). Furthermore, there has been proposed a method in which a catalyst withdrawn from the regenerating step is contacted with a hydrogen-containing reducing gas under conditions appropriate for eliminating influences of contaminating heavy metals and the catalyst is circulated to the cracking step (see Japanese Patent Application Laid-Open Specification No. 123289/83).

However, in the case where the cracking of a heavy oil having a high CCR content and high heavy metal contents is intended as in the present invention, the method for rendering accumulated heavy metals passive by addition of an antimony component or other heavy metal component is defective in that a large amount of the component for rendering the heavy metal passive should be used so as to control bad influences of contaminating heavy metals, and the treatment of the regenerated catalyst with a reducing gas is defective in that an additional step is necessary.

As means for thermal cracking of a heavy oil, there have been proposed a method and apparatus in which the heavy oil is contacted with a plurality of vertically piled zones having a fluidized bed of a granular carrier material at a high temperature in a gaseous atmosphere in which the hydrogen partial pressure of 2.5 to 14.1 $Kg/cm^2$, preferably 5.3 to 10.5 $Kg/cm^2$, and the total pressure is 10.5 to 56.2 $Kg/cm^2$ -G, preferably 17.6 to 45.7 $Kg/cm^2$ -G, or the total pressure is 14.1 to 56.2 $Kg/cm^2$ or higher (see Japanese Patent Publication No. 2172/59). This method may have some problems in that gases generated at the cracking step and the regenerating step cannot be separately taken out.

SUMMARY OF THE INVENTION

It is a primary object of the present invention to solve the foregoing problems involved in the conventional techniques, and this object can be attained by maintaining the partial pressure of hydrogen and the total pressure to appropriate levels at the thermal cracking step in the process for thermally cracking a heavy oil.

In accordance with the present invention, there is provided a process for the thermal cracking of heavy oils, which comprises a thermal cracking step of contacting a heavy oil with a fine powder of a porous material fluidized by a fluidizing gas to obtain mainly a light oil and a regenerating step of gasifying and removing coke adhering to the fine powder taken out from the thermal cracking step while fluidizing the fine powder by a molecular oxygen-containing gas and a steam-containing gas, the fine powder being circulated between the two steps, wherein fine spherical particles having a pore volume of 0.2 to 1.5 $cm^3$, a specific surface area of 5 to 1500 $m^2$, an average pore size of 10 to 10,000 Å and a weight average size of 0.025 to 0.25 mm, in which these properties are stably maintained at the temperature adopted for the thermal cracking, are used as the fine powder, and a hydrogen gas is made present at the thermal cracking step, the partial pressure of hydrogen is maintained at about 0.5 to about 5 $kg/cm^2$ and the total pressure at said step is maintained at about 1 to about 10 $Kg/cm^2$-G.

In addition to the advantages attained by the thermal cracking process using a fine powder of a porous material, proposed by some of the present inventors, the following further advantages can be attained.

(a) Since excessive dehydrogenation by heavy metals accumulated in the fluidized particles is controlled, the amount of coke formed and the amount of the cracked gas formed are reduced and the yield of the cracked oil is therefore high.

(b) Since the dehydrogenation reaction of the heavy oil is controlled and desulfurization or nitrogen-removing reaction is promoted, a cracked oil having a high quality can be obtained.

(c) Since the amount of heavy metals accumulated on fluidized particles can be increased, the amount of fluidizing particles to be supplied can be reduced and a heavy oil having high heavy metal contents can be used.

(d) Since a non-condensing cracked gas formed as a by-product at the thermal cracking step or a reducing gas (or its purified gas or steam-modified gas) formed as a by-product at the regenerating step can be used as at least a part of the fluidizing gas at the thermal cracking step, a large quantity of steam need not be used for the fluidization in contrast with the conventional process, and therefore, the consumption of steam for the fluidization can be saved or reduced to zero.

In the process for the thermal cracking of heavy oils, which comprises a thermal cracking step of contacting a heavy oil with a fluidized bed of fine particles of a porous material and a regenerating step of gasifying and removing coke adhering to the fine particles by contacting the fine particles taken out from the thermal cracking step with a steam-containing gas and a molecular oxygen-containing gas in the fluidized state, the fine particles being circulated between the two steps, if the hydrogen gas partial pressure in the gas at the thermal cracking step is maintained at about 0.5 to about 5 $Kg/cm^2$ and the total pressure is maintained at about 1 to about 10 $Kg/cm^2$=/G according to the present invention, excessive catalytic dehydrogenation of the heavy oil by heavy metals in the heavy oil can be controlled without substantial consumption of hydrogen for hydrogenation reaction of the heavy oil. This is a novel finding according to the present invention. The maintenance of the hydrogen partial pressure at about 0.5 to about 5 $Kg/cm^2$ at the thermal cracking pressure is attained by increasing the hydrogen concentration in the fluidizing gas to be introduced into the thermal cracking step while increasing the total gas pressure. For this purpose, a part or all of the steam-containing gas used as the fluidizing gas at the thermal cracking step in the conventional process may be substituted by a hydrogen-containing gas.

In Japanese Patent Application Laid-Open Specification No. 180590/83 proposed by some of the present inventors, it is taught that not only a hydrogen-containing gas but also a gas such as carbon monoxide, hydrogen, hydrocarbon, nitrogen or a mixture thereof can be used as the fluidizing gas at the thermal cracking step. Furthermore, in Japanese Patent Application Laid-Open Specification No. 115387/84, it is taught that a mixture of pure steam with carbon dioxide gas, carbon monoxide, hydrocarbon, nitrogen or a mixture thereof may be used as the fluidizing gas at the thermal cracking step. However, in these laid-open specifications, in connection of gases other than steam, specific effects of hydrogen with conditions for producing these effects are not disclosed at all.

BRIEF DESCRIPTION OF THE DRAWING

The drawing is a flow chart illustrating one embodiment of the present invention, in which reference numerals 1 and 2 represent a thermal cracking reactor and a regenerating reactor, respectively.

DETAILED DESCRIPTION OF THE PREFERRED EMBODIMENTS

Thermal Cracking Step Feed Heavy Oil

By the term "heavy oil" used herein is meant a hydrocarbon (ordinarily a mixture) having a CCR value larger than about 3, which is usually solid at normal temperature.

A feed heavy oil which can enjoy the effects of the present invention most conveniently has a relatively large CCR value, for example, a CCR value of at least about 5, preferably at least about 10. As specific examples of the heavy oil, there can be mentioned a heavy crude oil, a residue oil obtained by atmospheric pressure distillation of a crude oil (hereinafter referred to as "atmospheric pressure distillation residue oil"), a residual oil obtained by vacuum distillation of a crude oil (hereinafter referred to as "vacuum distillation residual oil"), a deasphalted oil, shale oil, tar sand oil and coal-liquefied oil.

Fine Particles

Fine particles used in the present invention are those of defined above.

More specifically, the pore volume of the particles used in the present invention is 0.2 to 1.5 $cm^3$, preferably 0.2 to 0.8 $cm^3$. The pore volume is a factor important for the capacitance effect. Namely, if the pore volume is smaller than 0.2 $cm^3/g$, the capacitance effect is insufficient, and if the pore volume exceeds 1.5 $cm^3/g$, the capacitance effect is sufficient but the particles become brittle. Accordingly, too small a pore volume or too large a pore volume is not preferred from the practical viewpoint. In view of the relation to the average pore size, it is preferred that the specific surface area of the fine particles be 5 to 1500 $m^2/g$, especially 20 to 500 $m^2/g$. The average pore size of the fine particles is 10 to 10,000 Å, preferably 20 to 2000 Å. If the pore size is smaller than 10 Å, pores are readily clogged with deposited coke, and if the pore size exceeds 10,000 Å, the force of sucking the heavy oil into the pores by the capillary pressure becomes insufficient and the particles become brittle. Accordingly, too small a pore size or too large a pore size is not preferred.

The fine particles used in the present invention have a weight average size of 0.025 to 0.25 mm, preferably 0.04 to 0.12 mm and are substantially spherical. It is indispensable that these properties should be stably maintained at the temperature adopted for the thermal cracking.

The fluidized bed of such fine particles is a so-called fine particles-fluidized bed, and as compared with a so-called coarse particles-fluidized bed of larger particles, the size of gas bubbles formed in the fluidized bed is small, the pressure fluctuation in the fluidized bed is small and the fluidized state is very uniform [Yoneichi Ikeda, Chemical Machine Techniques (in Japanese), 18, 191–218 (1966) and Miyauchi et al., Advances in Chem. Eng., 11, 275–448 (1981)]. In this uniform fluidized bed, transport of heat or substances is promoted in the thermal cracking or gassification, the operation is simple and the abrasion of the particles or apparatus is greatly reduced.

As preferred examples of the fine powder used in the present invention, there can be mentioned alumina and silica carrier materials for fluidized catalysts, deactivated or worn-out silica-alumina catalysts used in the FCC process, deactivated or worn-out aluminosilicate zeolite catalysts used in the FCC process, special spherical active carbon, pulverization products of natural porous materials and mixtures thereof. However, the fine powder that can be used in the present invention is not limited to those mentioned above, but any material having the above-mentioned properties may be used. The fine powder need not show a catalytic activity to the cracking reaction of a heavy oil.

Among the foregoing fine powders, an alumina carrier material for the fluidized catalyst is especially preferred, because it is excellent in the heat resistant and changes of the properties of the powder during the use are very slight.

Incidentally, by the term "pore volume" is meant the total volume of pores contained in the unit weight of the particles, and the value of the pore volume is ordinarily determined by soaking the porous material in a boiling liquid such as water, taking out the porous material, measuring the weight of the porous material in the state where the surface becomes dry and dividing the weight increase by the specific gravity of the liquid.

Thermal Cracking Step

The reactor used for the thermal cracking is a vertical reactor having a fluidized bed of the fine powder contained therein and it ordinarily has a shape of an elongated cylinder. The reactor has a fluidizing gas inlet at the lower end, an oil inlet in the intermediate portion and a thermal cracking product exit disposed on the top end to discharge the thermal cracking product through a device for recovering scattered particles, such as cyclones and dip-legs. Furthermore, the reactor comprises an inlet for receiving circulated particles from the regenerating step and an outlet for discharging particles to the regenerating step. Such a device as a heat exchanger or a perforated plate may be inserted in the reactor.

The present invention is characterized in that at the thermal cracking step, the partial pressure of hydrogen is maintained at about 0.5 to about 5 $Kg/cm^2$ and the total pressure is maintained at about 1 to about 10 $Kg/cm^2$-G. Incidentally, the hydrogen partial pressure and total pressure referred to in the instant specification indicate the values at the top of the thermal cracking reactor.

As pointed out hereinbefore, by maintaining the hydrogen partial pressure of the gas at about 0.5 to about 5 $Kg/cm^2$ at the thermal cracking step, the catalytic dehydrogenation of the heavy metal by the heavy metals contained in the heavy oil can be controlled without any substantial advance of the hydrogenation reaction of the heavy oil, that is, no substantial consumption of hydrogen. If the hydrogen partial pressure in the gas is higher than about 5 $Kg/cm^2$, especially about 7 $Kg/cm^2$, the hydrogenation reaction of the heavy oil is readily advanced, and if the hydrogen partial pressure is higher than about 10 $Kg/cm^2$, the hydrogenation reaction is a main reaction. If the hydrogen partial pressure is lower than about 0.5 $Kg/cm^2$, especially about 0.3 $Kg/cm^2$, it is impossible to control the catalytic dehydrogenation of the heavy oil by the heavy metals.

In order to maintain the hydrogen partial pressure in the gas within the above-mentioned range at the thermal cracking step, it is necessary to increase the total pressure and use a hydrogen-containing gas as the fluidizing gas. When the total pressure is increased, the pressure resistance should be increased in equipments and the operation becomes difficult. Accordingly, extreme elevation of the total pressure is not preferred. In the present invention, it is sufficient if the total pressure at the thermal cracking step is maintained at about 1 to about 10 $Kg/cm^2$-G.

Any hydrogen-containing gas can be used as the fluidizing gas, so far as the hydrogen partial pressure at the thermal cracking step can be maintained within the above-mentioned range. For example, there can be mentioned a high-purity hydrogen gas and a mixture of a high-purity hydrogen gas with steam, carbon dioxide gas, carbon monoxide, hydrocarbon, nitrogen or a mixture thereof. A non-condensing gas formed by removing condensing components such as a cracked oil and steam from a thermal cracking product obtained at the thermal cracking step is advantageously used as the hydrogen-containing gas. Furthermore, a part of the reducing gas obtained at the regeneration step described below can be used. This reducing gas comprises unreacted steam, carbon monoxide, hydrogen sulfide and other gases, and a gas having the hydrogen concentration elevated by at least one treatment selected from dehydrogenation, conversion of carbon monoxide to an aqueous gas, decarbonization and desulfurization is preferably used.

The use of $H_2$ at thermal cracking in accordance with the present invention is practiced, typically, when heavy metals deposited in a certain amount, for example, at least about 0.5% by weight, on the fluidized particles for suppression of dehydrogenation by the heavy metals deposited. Another advantage, however, is obtained such that extreme reduction of the sulfur content or nitrogen content is realized in the cracked oil by carrying out the present invention (see Table 1 given hereinafter). Accordingly, the present invention can be carried out by using fluidized particles in which appropriate amounts of transition metals contained in a heavy oil, such as Ni, V and Fe, have been deposited in advance. In order to exert the effect of the present invention, it is preferred that the amount of the heavy metals deposited on the particles be at least about 0.5% by weight, especially about 1% by weight. Incidentally, increase of the amount of the deposited heavy metals results in increase of the dehydrogenation, but under the working conditions of the present invention, the action of controlling the dehydrogenation is increased. Therefore, the upper limit of the amount of the deposited heavy metals is not particularly critical. However, if the heavy metals are accumulated in such a large amount as 30% by weight or more, the pore volume of the particles is reduced and the capacitance effect of the fine particles giving the inherent function of the present invention is lost. Therefore, deposition of such a large amount of the heavy metals should be avoided. It is especially preferred that the operation be carried out in the state where the amount of the heavy metals deposited is about 2 to about 20% by weight. Incidentally, the amount of the heavy metals deposited is expressed in terms of % by weight based on the fine particles.

It is preferred that the temperature of the fluidized bed for the thermal cracking be about 380 to about 600° C., especially 430 to 550° C. Within this temperature range, the yield of the oil formed is highest. It is preferred that the feed oil or hydrogen-containing gas be appropriately pre-heated and then fed.

In order to maintain a good fluidized state, it is preferred that the feed rate of the hydrogen-containing gas as the fluidized gas be adjusted so that the same rising speed of the gas in the fluidized bed as in the conventional process using a steam-containing gas can be maintained. More specifically, it is preferred that the rising speed of the gas in the fluidized bed be 5 to 160 cm/sec., especially about 10 to about 80 cm/sec., as the superficial velocity in a column.

In the present invention, since coke deposited on the fine powder is retained within the fine pores thereof, a good fluidized state can be maintained even if the amount of coke deposited is increased. Therefore, the amount of the particles circulated between the thermal cracking step and regenerating step can be greatly reduced as compared with the amount of particles circulated in the conventional process. It is ordinarily sufficient if the amount of the particles circulated between the two steps is 1 to 6 times by weight the amount of the feed heavy oil fed.

Thermal Cracking Product

The product oil obtained from the thermal cracking step of the present invention is liquid at normal temperature. For example, the product oil comprises a naphtha fraction (having a boiling point lower than 170° C.), a kerosene fraction (having a boiling point of 170 to 340° C.), a light oil fraction (having a boiling point of 340 to 540° C.) and a heavy oil fraction (having a boiling point higher than 540° C.). Since the process of the present invention is based on the thermal cracking reaction utilizing the capacitance effect of particles of a porous material, the product oil is different from the product obtained in the conventional catalytic cracking process in that the content of the naphtha fraction is low and the contents of intermediate fractions such as kerosene and light oil fractions are high. Furthermore, the content of the heavy oil fraction is very low.

In addition to the oil which is liquid at normal temperature, there is generated a cracked gas containing hydrogen in an amount corresponding to a calorific value of about 5000 to 10,000 Kcal/Nm$^3$ by the thermal cracking. In a preferred embodiment of the present invention, as pointed out hereinbefore, a gas formed by removing condensing components such as the cracked oil and steam from this cracked gas can be circulated and used as the fluidizing gas at the thermal cracking step.

Regenerating Step

Regenerating Operation

The main object of this step is to gasify and remove coke deposited in fine pores of the particles and to impart heat required at the thermal cracking step to the particles. Regeneration of the used powder comprises contacting the used powder in the fluidized state with a molecular oxygen-containing gas and a steam-containing gas.

The regenerating reactor is a vertical reactor having a fluidized bed of the fine powder contained therein and is ordinarily an elongated cylinder. The reactor comprises an inlet for the molecular oxygen-containing gas and steam-containing gas at the lower end, an exit arranged at the top end to discharge a formed gas through cyclones and dip-legs, an inlet for receiving particles circulated from the thermal cracking step and an opening disposed to discharge the circulated particles to the thermal cracking step. Incidentally, a heat exchanger or a perforated plate may be inserted in the reactor according to need.

In the conventional process, only air is fed as the fluidizing gas at the regenerating step. In the present invention, however, an appropriate amount of steam may be incorporated in an oxygen-containing gas as the fluidizing gas to form a reducing gas.

In carrying out the present invention, it is preferred that the gasifying reaction be sufficiently advanced to obtain a reducing gas having high contents of CO and H2. In order to advance the reducing reaction, it is preferred that the amount of coke deposited on the fine powder be about 5 to about 20% by weight. For the same reason, it also is preferred that the temperature at which the fine powder is fluidized be elevated to increase the reaction speed. Namely, it is preferred that the reaction temperature be higher than 700° C., especially about 750 to about 1000° C.

Since the gas formed should stay in the fluidized bed for a time necessary for sufficiently advancing the reducing reaction, it is necessary that the height of the fluidized bed be as large as possible, and it is preferred that the apparent contact time of the product gas (that is, the ratio of the height of the fluidized bed to the superficial velocity of the gas in a column) be about 5 to about 50 seconds.

In order to reduce the content of the inert component (for example, nitrogen) in the gas, that is, in order to increase the contents of CO and H2, it is preferred that a gas having a high oxygen content be used as the fluidizing gas.

It is preferred that the fluidizing gas be appropriately pre-heated and then fed. A small amount of hydrogen, carbon monoxide, nitrogen, hydrocarbon or a mixture thereof may be incorporated into the fluidizing gas.

The rising speed of the gas component in the fluidized layer is 5 to 160 cm/sec., preferably about 10 to about 80 cm/sec., as the superficial velocity in a column. It is preferred that the pressure be substantially the same as the pressure at the thermal cracking step, and ordinarily, the pressure is maintained at about 1 to about 10 Kg/cm$^2$-G.

The performance of the reaction in the fluidized bed varies greatly according to the fluidized state. For example, if large gas bubbles are formed in the fluidized bed, these gas bubbles flow out through the fluidized bed without being contacted with the particles or participating in the reaction. Accordingly, in order to sufficiently advance the reaction in the fluidized bed, it is necessary to produce a good fluidized state where no large gas bubbles are formed and small gas bubbles are uniformly dispersed in the fluidized bed.

A typical fluidized bed of particles is produced in the present invention and this layer shows a very uniform good fluidized state, and therefore, the reducing reaction can be easily advanced to such an extent that a strongly reducing gas can be obtained.

In the present invention, there may be adopted an embodiment in which the regenerating step comprises gasifying coke adhering to the fine powder with steam and burning it with molecular oxygen and the formed reducing gas and the combustion gas are separately taken out, as proposed in Japanese Patent Application Laid-Open Specification No. 180590/83.

Gas Formed at Regenerating Step

At the regenerating step, there is obtained a highly reducing gas having high contents of CO and H2. This gasifying gas has a calorific value of at least about 2000 Kcal/$Nm^3$ and is valuable as a fuel or a feed gas for the synthesis. As pointed out hereinbefore, the reducing gas may be used as the fluidizing gas at the thermal cracking step, if necessary after at least one treatment selected from dehydration, conversion of carbon monoxide to H2 by shift reaction, removal of CO2 and removal of H2 S.

Flow Sheet

The drawing shows an example of the flow sheet for carrying out the thermal cracking according to the present invention.

In the drawing, reference numeral 1 represents a thermal cracking reactor for thermally cracking a heavy oil, and reference numeral 2 represents a regenerating reactor for gasifying and removing coke adhering to the fine powder taken out from the cracking reactor by the thermal cracking reaction. Reference numeral 3 represents a cooler for cooling the thermal cracking reaction product to separate a product oil from a cracked gas.

Hydrogen or a hydrogen-containing gas from a line 4 is optionally mixed with steam or a steam-containing gas from a line 5, and the hydrogen-containing gas having a predetermined hydrogen partial pressure is fed to the bottom of the thermal cracking reactor 1 from a line 6. A heavy oil is fed into the thermal cracking reactor 1 from a line 7 singly or together with steam or the like. The fine powder filled in the thermal cracking reactor is fluidized by the material fed under pressure, and under a predetermined pressure, the thermal cracking reaction is advanced mainly above the position for the feed of the heavy oil. Below this position, the product oil retained in pores of the fine powder is stripped while the fine powder passes through a perforated plate 8 and falls down in the reactor.

Fine particles accompanying the thermal cracking product are removed by a cyclone 9 and dip-leg 10 arranged on the top of the reactor and the thermal cracking product passes through a line 11 and a cooler 3. The liquid condensed in the cooler 3, that is, a product oil, is separated into a receiver 12, and the non-condensing gas, that is, a cracked gas, is taken out from the system through a line 13.

According to a preferred embodiment, the non-condensing cracked gas taken out through the line 13 is introduced as the hydrogen-containing gas under a predetermined pressure into a line 4 through a line 28 and is fed (circulated) into the bottom of the thermal cracking reactor through a line 6.

The fine powder having coke adhering thereto as the result of the thermal cracking is discharged from a line 14 at the bottom of the reactor and is fed into the regenerating reactor 2 through a cyclone 18 and dip-leg 19 via a line 17 by an ejector 16 with nitrogen or steam supplied from a line 15, while the gas such as nitrogen or steam is discharged from the system through a line 20.

Steam or a steam-containing gas from a line 22, that is, a gas containing oxygen at a high concentration or pure oxygen, and the mixture is fed into the bottom of the regenerating reactor. The coke-adhering particles fed from the thermal cracking reactor and filled in the regenerating reactor are fluidized by a gas fed from a line 23, and a part of the adhering coke is gasified. The reducing gas formed is passed through a cyclone 24 and dip leg 25 arranged at the top of the regenerating reactor to remove the accompanying fine particles, and the gas is taken out from the system through a line 26. The particles which have been subjected to the gasifying reaction are circulated to the thermal cracking reactor through an overflowing tube 27.

If desired, instead of circulation and use of the non-condensing cracked gas from the line 28, a part of the reducing gas withdrawn from the tube path 26 may be introduced to a gas-treating apparatus 30 through a line 29 where the gas is subjected to at least one treatment selected from dehydration, shift reaction of CO to $H_2$, removal of $CO_2$ and removal of $H_2$ S, and the treated gas may be passed through a line 31 and fed (circulated) into the bottom of the thermal cracking reactor through a line 4.

Experimentation (1) Experimental Apparatus

An experimental apparatus as shown in the drawing was used. The thermal cracking reactor had a cylindrical shape in which the inner diameter was 5.4 cm and the height of the fluidized bed portion was about 1.8 m. The heavy oil feed tube was located at a position 0.6 m apart from the lower end of the reactor and the portion having a height of 1.2 m from the feed tube constituted a main thermal cracking reaction zone, and the portion having a length of 0.6 m from the feed tube constituted a stripping zone. In the stripping zone, there were arranged 5 perforated plates having an open area of about 20% based on the horizontal cross-sectional area of the fluidized bed at intervals of 10 cm. The regenerating reactor had an inner diameter of 8.1 cm and a fluidized bed height of about 1.5 m. The entire reaction apparatus was made with stainless steel.

(2) Common Experimental Conditions

About 3 Kg of fine particles of an alumina type porous material or these particles on which Ni and V components were deposited were fed into the thermal cracking reactor as the particles to be fluidized. A predetermined amount of steam and/or pure hydrogen preheated at about 400° C. was fed from the feed tube at the bottom of the thermal cracking reactor, and a heavy oil pre-heated at about 300° C. was sprayed at a rate of 600 g/hr from the oil feed tube together with 50 g/hr of steam pre-heated at about 400° C. The coke-deposited particles were continuously discharged from the bottom of the thermal cracking reactor and circulated at a rate of about 2.5 Kg/hr to the regenerating reactor with nitrogen.

Predetermined amounts of steam pre-heated at about 400° C. and oxygen at normal temperature were fed into the bottom of the regenerating reactor through the feed tube. The fine particles from which the deposited coke had been removed by the gasifying reaction were circulated to the thermal cracking reactor through the overflowing tube.

By external electric heating, the temperature of the fluidized bed in the thermal cracking reactor was maintained at 450° C. and the temperature of the fluidized bed in the regenerating reactor was maintained at 820° C. The pressure was maintained at a certain level within a range of about 2 to about 5 $Kg/cm^2$ -G as described hereinafter. The specific speed of the gas in a column was about 12 cm/sec. in the thermal cracking reactor.

The thermal cracking product was cooled to normal temperature by water and brine to condense water and the product oil and separate them from the cracked gas.

The feed heavy oil was a reduced pressure distillation residual oil having a specific gravity of 1.026, a heavy oil fraction (having a boiling point higher than 540° C.) content of 93% by weight, a CCR value of 21.9% by weight and a sulfur content of 5.9% by weight.

COMPARATIVE EXAMPLE 1

Fine particles of an alumina type porous body designed for use as a fluidized catalyst carrier were used as the particles to be fluidized and steam was fed at a rate of 778 g/hr from the feed tube at the bottom of the thermal cracking reactor, and the thermal cracking of the heavy oil was carried out under a pressure of 2 $Kg/cm^2$ -G. Incidentally, 600 g/hr of steam and 7 N liter/hr of oxygen were fed from the feed tube at the bottom of the regenerating reactor.

The hydrogen partial pressure at the top of the thermal cracking reactor was 0.01 $Kg/cm^2$. The fine particles used had a bulk density of 0.39 $g/cm^3$, a pore volume of 1.36 $cm^3/g$, a specific surface area of 320 $m^2/g$, an average pore size of 260 Å and a weight average size of 0.068 mm.

COMPARATIVE EXAMPLE 2

In order to examine the influence of heavy metals on the thermal cracking of the heavy oil, fine particles of an alumina type porous material having the same properties as those of the fine particles used in Comparative Example 1 were impregnated with 1.5% by weight of a Ni component and 4.9% by weight of a V component (based on the fine particles) according to the conventional impregnation method, and the impregnated particles were used as the fine particles and the thermal cracking of the heavy oil was carried out under the same conditions as described in Comparative Example 1.

The hydrogen partial pressure at the top of the thermal cracking reactor was increased to 0.39 $Kg/cm^2$ by the dehydrogenation reaction by the heavy metals at the thermal cracking step.

EXAMPLE 1

The same particles as used in Comparative Example 2 were used as the particles to be fluidized, and the thermal cracking of the heavy oil was carried out by feeding 226 g/hr of steam and 690 N liter/hr of pure hydrogen from the feed tube at the bottom of the thermal cracking reactor while adjusting the pressure at the top of the thermal cracking reactor to 2 $Kg/cm^2$ -G. Furthermore, 600 g/hr of steam and 110 N liter/hr of pure oxygen were fed from the feed tube at the bottom of the regenerating reactor.

Incidentally, the hydrogen partial pressure at the top of the thermal cracking reactor was 2.0 $Kg/cm^2$.

EXAMPLE 2

The thermal cracking of the heavy oil was carried out under the same conditions as described in Example 1 except that 970 N liter/hr of pure hydrogen was fed as the fluidizing gas to the feed tube at the bottom of the thermal cracking reactor (accordingly, steam fed into the thermal cracking reactor was about 50 g/hr of steam fed simultaneously with the heavy oil). Incidentally, 600 g/hr of steam and 70 N liter/hr of pure oxygen were fed from the feed tube at the bottom of the regenerating reactor.

The hydrogen partial pressure at the top of the thermal cracking reactor was 2.7 $Kg/cm^2$.

EXAMPLE 3

The thermal cracking of the heavy oil was carried out by using the same particles as used in Comparative Example 2 and feeding 310 N liter/hr of pure hydrogen from the feed tube at the bottom of the thermal cracking reactor (steam fed into the thermal cracking reactor was only 50 g/hr which was supplied together with the heavy oil). The pressure at the bottom of the thermal cracking reactor was 3 $Kg/cm^2$ -G. Furthermore, 800 g/hr of steam and 50 N liter/hr of pure oxygen were supplied from the feed tube at the bottom of the regenerating reactor.

Incidentally, the hydrogen partial pressure at the top of the thermal cracking reactor was 3.7 $Kg/cm^2$.

COMPARATIVE EXAMPLE 3

The thermal cracking of the heavy oil was carried out by using the same fine particles as used in Comparative Example 2, feeding 2000 N liter/hr of pure hydrogen was fed from the feed tube at the bottom of the thermal cracking reactor (steam fed to the thermal cracking reactor was only 50 g/hr which was fed together with the heavy oil) and adjusting the pressure at the top of the thermal cracking reactor to 5 $Kg/cm^2$ -G. Furthermore, 1000 g/hr of steam and 60 N liter/hr of pure oxygen were supplied from the feed tube at the bottom of the regenerating reactor.

The hydrogen partial pressure at the top of the thermal cracking reactor was 5.7 $Kg/cm^2$.

(3) Experimental Results

In each of the foregoing examples, over a period of 1 hour from the point when about 5 hours had passed from the point of initiation of the feeding of the heavy oil and the stationary state was considered to be attained, the experimental data were collected. The yield and composition of the cracked oil, the yield and composition of the cracked gas and the yield of the coke are shown in Tables 1 through 3.

In each of the examples, a gas comprising 20 to 40% by volume based on the dry gas on CO2, 20 to 40% by volume based on the dry gas of CO, 30 to 50% by volume based on the dry gas of H2 and 2 to 3% b volume based on the dry gas of H2 S was obtained at a rate of 550 to 800 N liter/hr at the regenerating step.

The content of carbon deposited on the fine particles was about 15 to about 20% by weight based on the fine particles in the thermal cracking reactor and about 5 to about 10% by weight based on the fine particles in the regenerating reactor, as determined according to the conventional method. The difference of the deposited carbon content before and after the reaction period of 1 hour was within about 1% by weight.

TABLE 1

Yield and Composition of Cracked Oil

| | Experiment No. | | | | | |
|---|---|---|---|---|---|---|
| | Comp. Ex. 1 | Comp. Ex. 2 | Example 1 | Example 2 | Example 3 | Comp. Ex. 3 |
| Total Pressure*1 ($Kg/cm^2$-G) | 2 | 2 | 2 | 2 | 3 | 5 |
| $H_2$ Partial Pressure*1 ($Kg/cm^2$) | 0.01 | 0.39 | 2.0 | 2.7 | 3.7 | 5.7 |
| Yield of cracked oil*2 (% by wt.) | 68.6 | 50.5 | 60.1 | 67.9 | 69.0 | 69.4 |
| Composition of Cracked Oil (% by wt.) | | | | | | |
| Naphtha (bp < 170° C.) | 16 | 19 | 14 | 21 | 19 | 21 |
| Kerosene (bp: 170–340° C.) | 34 | 47 | 47 | 39 | 38 | 38 |
| Light oil (bp: 340–540° C.) | 48 | 32 | 37 | 38 | 41 | 40 |
| Heavy oil (bp > 540° C.) | 2 | 2 | 2 | 2 | 2 | 1 |
| Total sulfur*3 (% by wt.) | 2.0 | 1.7 | 1.5 | 1.4 | 1.2 | 1.1 |
| Total nitrogen*3 (ppm) | 2,380 | 1,340 | 1,170 | 1,060 | 1,570 | 1,500 |

*1at top of the thermal cracking reactor
*2based on the heavy oil fed
*3in the cracked oil From the results shown in Table 1, it is seen that through the yield of the cracked oil in Comparative Example 2 was reduced by about 8% as compared with the yield obtained in Comparative Example 1 because of the influence of the adhering heavy metal, by producing a certain partial pressure in the thermal cracking reactor, the yield could be restored sustantially to the level before the contamination of the particles with the heavy metals. Furthermore, it is seen that if hydrogen was made present, the sulfur content or nitrogen content in the cracked oil could be lowered as compared with the level obtained in the conventional process.

TABLE 2

Yield and Composition of Cracked Gas

| | Experiment No. | | | | | |
|---|---|---|---|---|---|---|
| | Comp. Ex. 1 | Comp. Ex. 2 | Example 1 | Example 2 | Example 3 | Comp. Ex. 3 |
| Yield of Cracked Gas (% by wt.) | 6.0 | 8.1 | 7.3 | 7.2 | 7.7 | 8.1 |
| Composition of Cracked Gas* (vol. %) | | | | | | |
| $H_2$ | 12 | 80 | 50 | 27 | 6 | |
| $CH_4$ | 39 | 9 | 24 | 34 | 42 | 45 |
| $C_2H_6$,$C_2H_4$ | 21 | 5 | 12 | 15 | 19 | 20 |
| $C_3H_8$,$C_3H_6$ | 11 | 3 | 6 | 9 | 9 | 10 |
| $CO_2$,CO | 1 | | | 2 | 3 | 3 |
| $H_2S$ | 16 | 3 | 8 | 13 | 21 | 22 |
| Amount of $H_2$ generated** (N-lit./Kg) | 7 | 250 | 64 | 24 | 4 | −20 |

Note
*Yield of the cracked gas based on the heavy oil fed, where hydrogen fed was subtracted from each value.
**The amount of hydrogen formed based on the heavy oil fed calculated according to the following formula: Amount of Hydrogen Formed = (A − B)/C wherein A stands for the amount of hydrogen at the top of the thermal cracking reactor, B stands for the amount of hydrogen fed and C stands for the amount of the oil fed.

From the results shown in Table 2, it is seen that in Comparative Example 2, H2 formed in an amount about 35 times the amount of H2 formed in Comparative Example 1 due to the influences of the heavy metals, but if a certain hydrogen partial pressure was held in the thermal cracking reactor, the amount of formed hydrogen could be reduced to the level before the contamination of the fluidized particles with the heavy metals. Furthermore, from the results of Comparative Example 3, it is seen that if the hydrogen partial pressure in the reactor exceeded a certain level, consumption of hydrogen was caused and the hydrogenation of the cracked oil took place.

TABLE 3

Yield of Coke

| Experiment No. | Yield (% by weight) of Coke* |
|---|---|
| Comparative Example 1 | 25.4 |
| Comparative Example 2 | 41.4 |
| Example 1 | 32.6 |
| Example 2 | 24.9 |
| Example 3 | 23.3 |
| Comparative Example 3 | 22.5 |

*The yield of coke was estimated according to the formula of yield of coke = 100 − (yield of cracked oil + yield of cracked gas).

From the results shown in Table 3, it is seen that the yield of the coke in Comparative Example 2 was 1.5 times the yield of the coke in Comparative Example 1 by the influences of the heavy metal, but if a certain hydrogen pressure was produced in the thermal cracking reactor, the yield of the coke could be controlled to the level before the contamination of the fluidized particles with the heavy metals.

What is claimed is:

1. A process for the thermal cracking of heavy oils having a Conradson carbon residue, CCR value greater than 3, which comprises:

thermal cracking a heavy oil by contacting said heavy oil with a fluidized bed of fine, porous particles having a pore volume of 0.2 to 1.5 $cm^3/g$, a specific surface area of 5 to 1500 $m^2/g$, an average pore size of 10 to 10,000 Å, a weight average size of 0.025 to 0.25 mm at an elevated temperature sufficient to thermally crack said oil, and said particles having heavy metal deposited thereon, which is obtained from the heavy oil which inherently contains heavy metal, in an amount of at least 0.5% by weight, said bed being fluidized with a hydrogen containing gas at a velocity such that the partial pressure of hydrogen ranges from about 0.5 to about 5 $kg/cm^2$ while the total pressure in said cracking step ranges from about 1 to about 10 $kg/cm^2$-G, thereby producing a light oil product having a boiling point which is lower than the heavy oil feed without substantial consumption of the hydrogen gas being used while reducing the amount of coke which forms during thermal cracking; and regenerating fine, porous particles withdrawn from said thermal cracking step which have coke adhered thereto by fluidizing said coked particles with a molecular oxygen-containing gas and a steam-containing gas and recirculating said regenerated particles to said thermal cracking step.

2. The process of claim 1, wherein at least a portion of the fluidizing gas utilized in the thermal cracking step is a non-condensing gas of a cracked gas formed during the thermal cracking step.

3. The process of claim 1, wherein at least a portion of the fluidizing gas of the thermal cracking step is a portion of a reducing gas formed during said regeneration step.

4. The process of claim 1, wherein said fine, porous particles employed in the thermal cracking step have a heavy metal deposited thereon in an amount of 0.5 to 30 wt. %.

5. The process of claim 1, wherein said fine particles consist essentially of alumina.

6. The process of claim 1, wherein the temperature of said thermal cracking step ranges from 380° to 600° C.

7. The process of claim 6, wherein said temperature range is from 430° to 550° C.

8. The process of claim 1, wherein the velocity of said fluidizing hydrogen gas in the fluidizing step ranges from 5 to 160 cm/sec.

9. The process of claim 1, wherein said heavy oil is heavy crude oil, atmospheric pressure distillation residual oil, vacuum distillation residual oil, deasphalted oil, shale oil, tars sand oil or oil derived from the liquification of coal.

10. The process of claim 1, wherein said fine, porous particles have a pore volume ranging from 0.2 to 0.8 $cm^2/g$, the specific surface area ranges from 20 to 500 $M^2$ 2,000 Å and the weight average size of the particles ranges from 0.04 to 0.12 mm.

11. The process of claim 1, wherein the partial pressure of hydrogen ranges from 2.7 to 5 $kg/cm^2$.

* * * * *